US010280607B2

(12) United States Patent
Wagner, III

(10) Patent No.: US 10,280,607 B2
(45) Date of Patent: May 7, 2019

(54) CONNECTION SYSTEM AND METHOD OF USING SAME

(71) Applicant: Fred A. Wagner, III, Charlotte, NC (US)

(72) Inventor: Fred A. Wagner, III, Charlotte, NC (US)

( * ) Notice: Subject to any disclaimer, the term of this patent is extended or adjusted under 35 U.S.C. 154(b) by 0 days.

(21) Appl. No.: 15/729,963

(22) Filed: Oct. 11, 2017

(65) Prior Publication Data

US 2018/0119408 A1 May 3, 2018

Related U.S. Application Data

(60) Provisional application No. 62/413,578, filed on Oct. 27, 2016.

(51) Int. Cl.
*E04B 1/19* (2006.01)
*E04B 1/24* (2006.01)

(52) U.S. Cl.
CPC ..... *E04B 1/1903* (2013.01); *E04B 1/2403* (2013.01); *E04B 2001/193* (2013.01); *E04B 2001/1957* (2013.01); *E04B 2001/2415* (2013.01); *E04B 2001/2451* (2013.01)

(58) Field of Classification Search
CPC .. E04B 1/1903; E04B 1/24; E04B 2001/2415; E04B 2103/06; E04B 2/58; E04B 2001/193; E04B 2001/1957; E04B 2001/1993; E04B 19/2403
See application file for complete search history.

(56) References Cited

U.S. PATENT DOCUMENTS 2,747,887 A * 5/1956 Schilberg ..... B62D 21/06 280/794
3,499,258 A * 3/1970 Durand ..... B66C 23/286 29/464
3,512,811 A * 5/1970 Moody ..... E02B 17/0008 285/288.1
3,674,289 A * 7/1972 Geraci ..... E04B 1/2403 29/897.3
3,769,772 A * 11/1973 Oetiker ..... A47C 17/64 52/646

(Continued)

OTHER PUBLICATIONS

Wikipedia, "Electrical Conduit" dated Oct. 25, 2016.

(Continued)

*Primary Examiner* — Beth A Stephan
(74) *Attorney, Agent, or Firm* — Hammer & Associates, P.C.

(57) ABSTRACT

A method for erecting or assembling a frame includes the steps of: forming a joint with at least two frame members placed at an angle to one another, each frame members is a metal tube, no coping nor fittings are used to form the joint; wrapping the joint with a saddle, the saddle is a bent flat metal member with at least one hole overlaying each frame member; and plug welding the saddle to each frame member by filling each hole with weld metal. A frame includes: a joint formed by at least two frame members set at an angle to one another, each frame member is a metal tube; a saddle is wrapped over the joint, the saddle is a flat metal member with at least one hole overlaying each frame member; and a plug weld joining the saddle to each frame member, via weld metal filling the hole.

10 Claims, 6 Drawing Sheets

(56) References Cited

U.S. PATENT DOCUMENTS

| | | | | | |
|---|---|---|---|---|---|
| 5,013,176 | A * | 5/1991 | Orbom | E04B 1/1903 | 403/171 |
| 5,284,289 | A * | 2/1994 | Killian | B23K 9/0026 | 188/205 R |
| 5,918,998 | A * | 7/1999 | Pourmand | A47B 47/005 | 403/169 |
| 6,089,778 | A * | 7/2000 | Hirano | G09F 15/0012 | 40/782 |
| 6,205,739 | B1 * | 3/2001 | Newlin | E04B 1/19 | 52/645 |
| 6,402,414 | B1 * | 6/2002 | Kanodia | B62D 23/005 | 296/205 |
| 6,962,262 | B2 * | 11/2005 | Toma | F16B 12/50 | 211/182 |
| 7,143,550 | B1 * | 12/2006 | Lopez | E04B 1/19 | 52/81.3 |
| 2001/0000119 | A1 * | 4/2001 | Jaekel | B23K 26/38 | 296/29 |
| 2005/0084324 | A1 * | 4/2005 | Dubensky | E04B 1/3483 | 403/305 |
| 2007/0246235 | A1 * | 10/2007 | Connell | A01B 51/00 | 172/776 |
| 2008/0238144 | A1 * | 10/2008 | Kamimae | B62D 33/0617 | 296/190.08 |
| 2017/0312563 | A1 * | 11/2017 | Chen | A63B 5/11 | |

OTHER PUBLICATIONS

The Basics of Steel Conduit, "The strength and versatility of this oft-refined product line maintain its popularity on many a jobsite" dated Oct. 25, 2016.

Migwelding, "Plug Welding" dated Oct. 25, 2016.

* cited by examiner

CONNECTION SYSTEM AND METHOD OF USING SAME

RELATED APPLICATION

This application claims the benefit of U.S. Provisional Application Ser. No. 62/413,578 filed Oct. 27, 2016.

FIELD OF THE INVENTION

The invention is directed to a connection system used in the erection of framing.

BACKGROUND OF THE INVENTION

A framing system may be a structural (i.e., load bearing) system, or a non-structural (i.e., a non-load bearing) system. A non-structural framing system is not intended for use in load bearing applications. Non-structural framing systems have practical applications including, for example, building mock-ups or light-weight structures, prototyping, product development, shop work, fencing, tent frames, awnings, theater/stage structures, artistic structures, and the like.

In typical frames made with metal tubing, the joints have to be coped (i.e., cut to fit, e.g., beveled) and then joined, or joints are formed with fittings or with metal strapping and screws. Both of these techniques are time consuming, and therefore, they are not used for this type of framing.

Accordingly, there is a need for a framing system and method for making same that is easily assembled of readily available components. The framing system may be a non-structural framing system.

SUMMARY OF THE INVENTION

A method for erecting or assembling a frame includes the steps of: forming a joint with at least two frame members placed at an angle to one another, each frame members is a metal tube, no coping nor fittings are used to form the joint; wrapping the joint with a saddle, the saddle is a bent flat metal member with at least one hole overlaying each frame member; and plug welding the saddle to each frame member by filling each hole with weld metal. A frame includes: a joint formed by at least two frame members set at an angle to one another, each frame member is a metal tube; a saddle is wrapped over the joint, the saddle is a flat metal member with at least one hole overlaying each frame member; and a plug weld joining the saddle to each frame member, via weld metal filling the hole.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
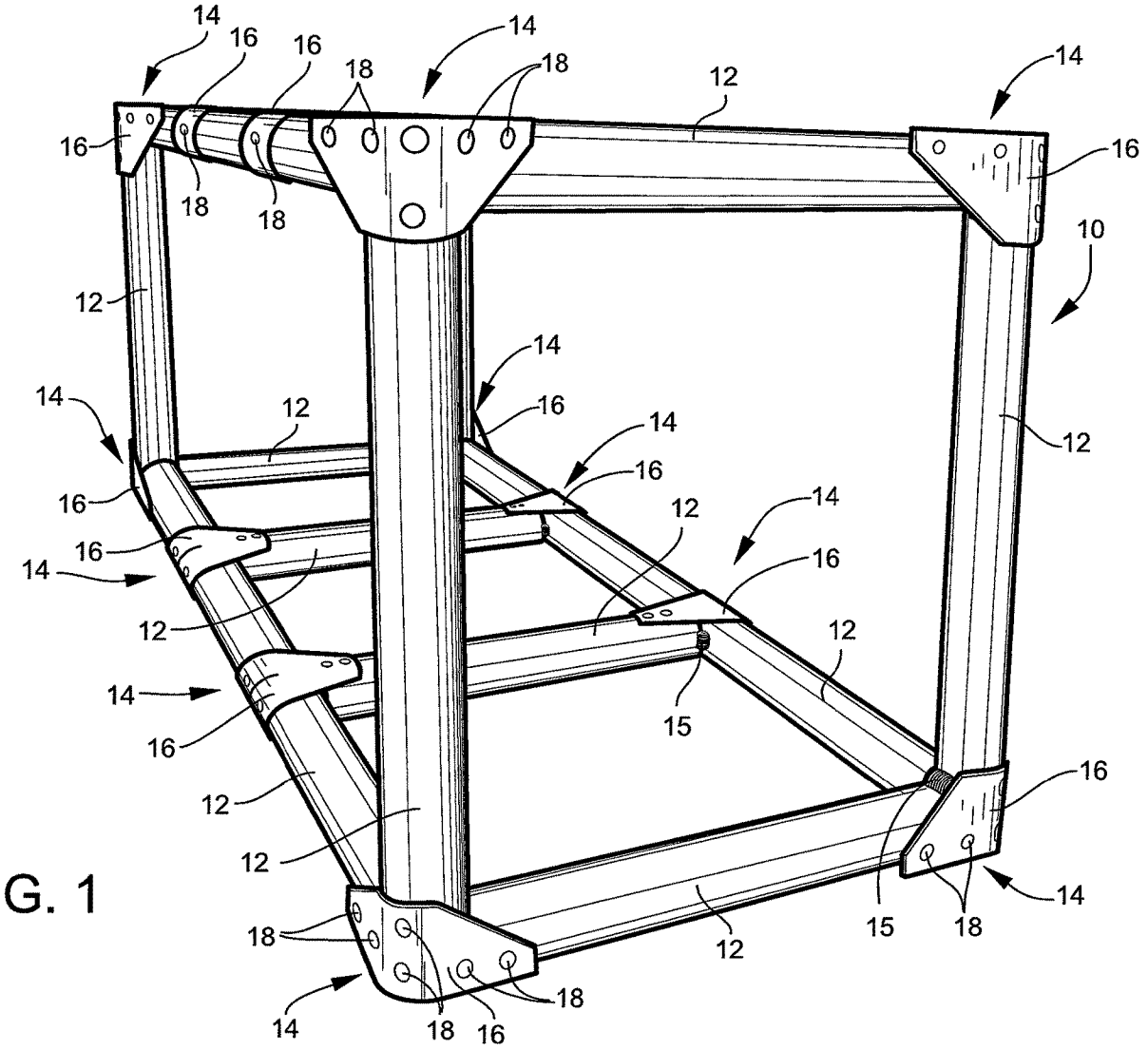
FIG. 1 is an isometric view of a frame make with an embodiment of the instant invention.
Figure 2:
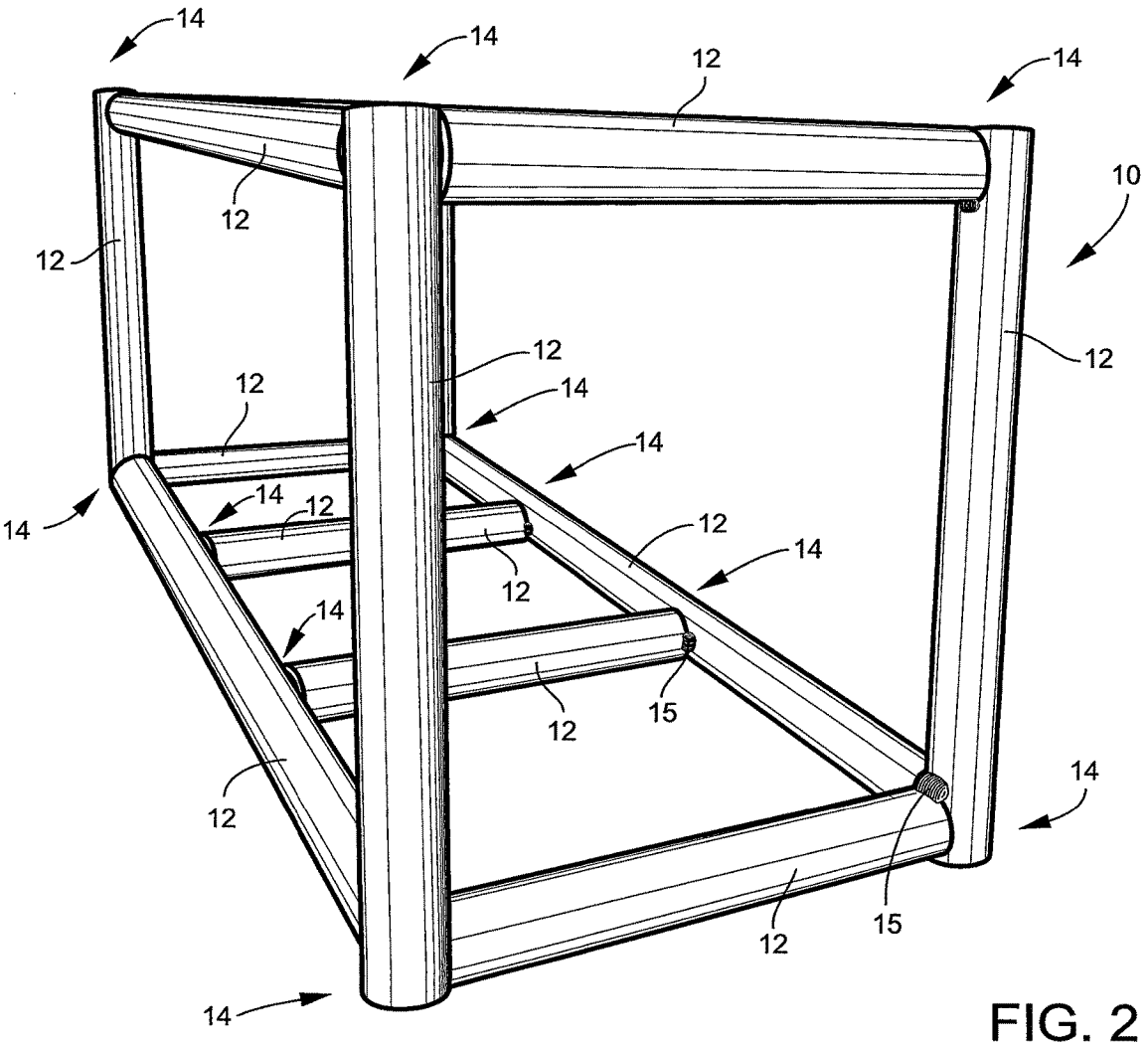
FIG. 2 is an isometric view of the tack welded frame.

Referring to the drawings, where like numerals are used to indicate like elements, there is shown a connection system for erecting frame. The framing 10 may be a structural system or a non-structural system. Non-structural frames are frames that are not load bearing. To simply the discussion hereinafter, only a non-structural framing system will be discussed, but the system described below may be equally applicable to a structural framing system.

Referring to FIG. 1, assembled frame 10 is illustrated. Frame 10 includes several frame members 12 and joints 14 with saddles 16 plug welded 18 to frame members 12.

Frame members 12 are members. The frame members 12 may be tubular or solid. The frame members 12 may have any cross-sectional shape including, but not limited to circular, oval, square, rectangular, trapezoidal, L, and/or T. Frame members 12 may be electrical metallic tubing conduit, for example thin-walled conduit. Electrical metallic tubing may refer to any such conduit, for example, see: http://ecmweb.com/content/basics-steel-conduit and https://en.wikipedia.org/wiki/Electrical_conduit, both incorporated herein by reference. Frame members 12 may be made of thicker walled tubing, for example, black iron pipe (water pipe), if a structural framing system is desired.

Figure 3:
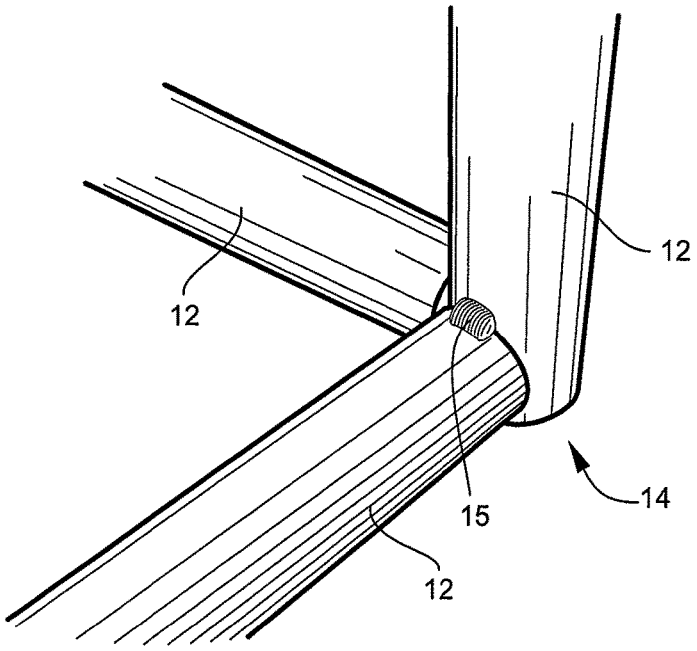
FIG. 3 is a view of a tack weld.
Figure 7:
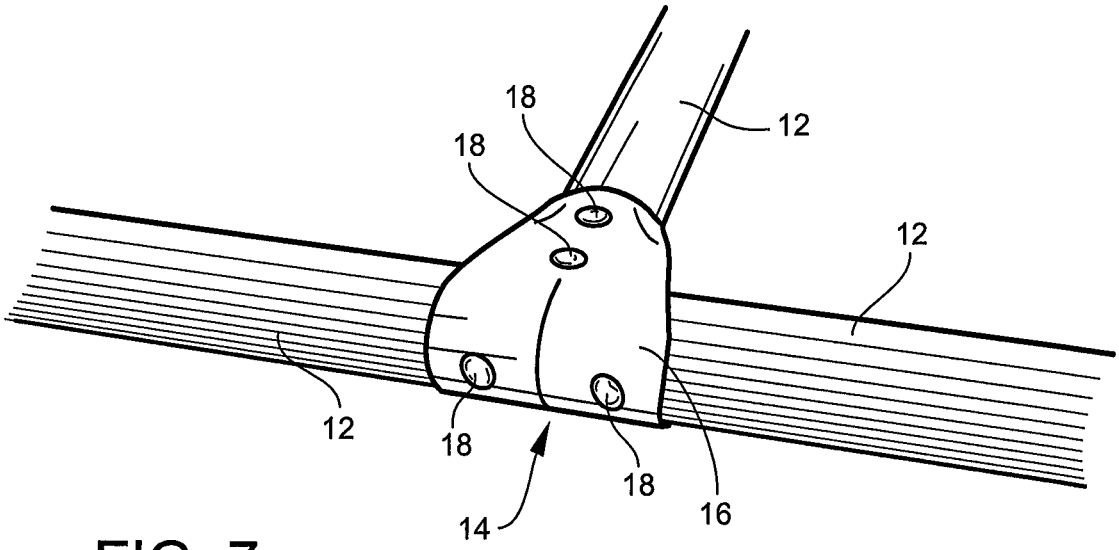
FIG. 7 is a view of finished plug welds.
Figure 9:
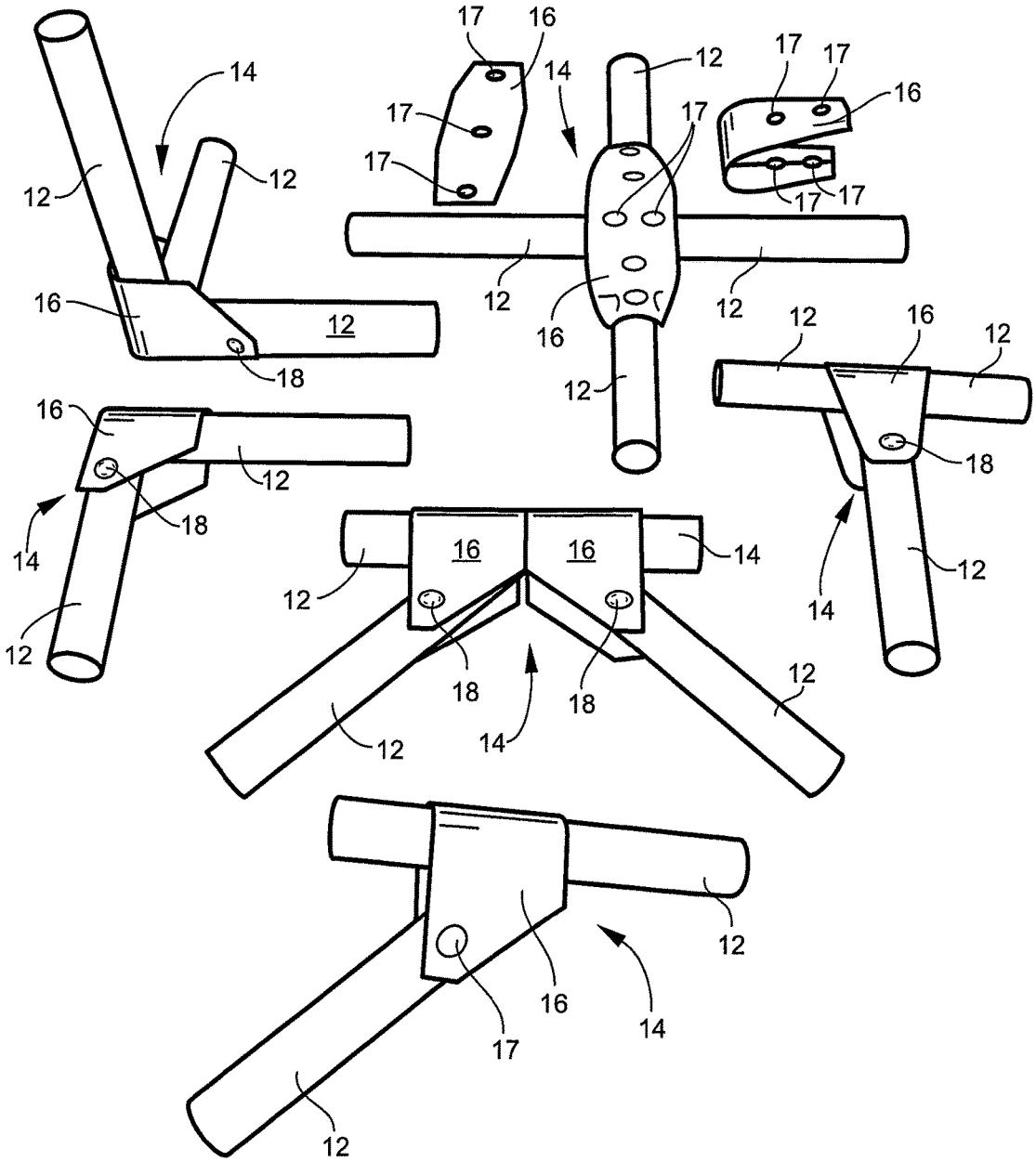
FIG. 9 is a view of several examples of joints made according to the instant invention.

Joint (or cluster) 14 is formed with at least two frame members 12 placed at an angle to one another. In joint 14, each frame member 14 abuts another member, see, for example, FIG. 3. The angles include, for example, 90°, 180°, and 45°, but the angle may be any angle as necessitated by the frame 10. Exemplary angles are shown in FIG. 3 (corner joint), FIG. 7 (T joint), and FIG. 9 (multiple joints illustrated). No coping nor fittings are used to form the joint.

Figure 4:
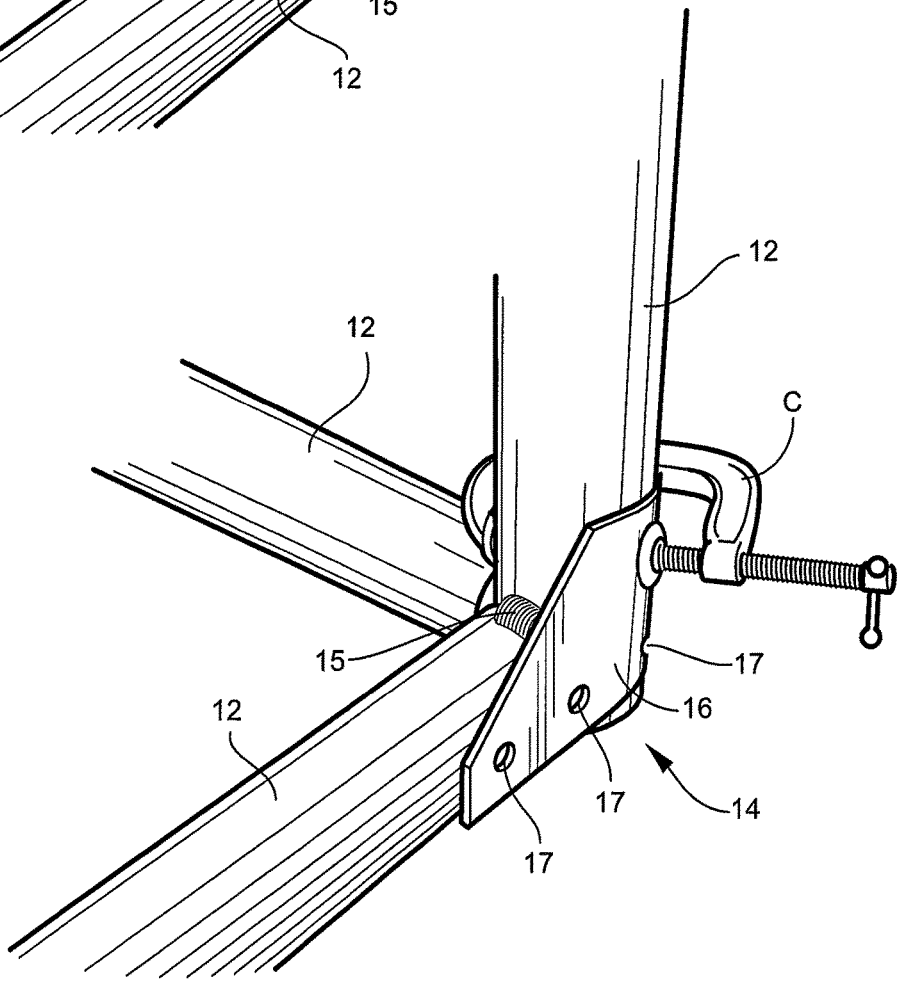
FIG. 4 is a view of holding (or clamping) a saddle to members prior to plug welding.
Figure 5:
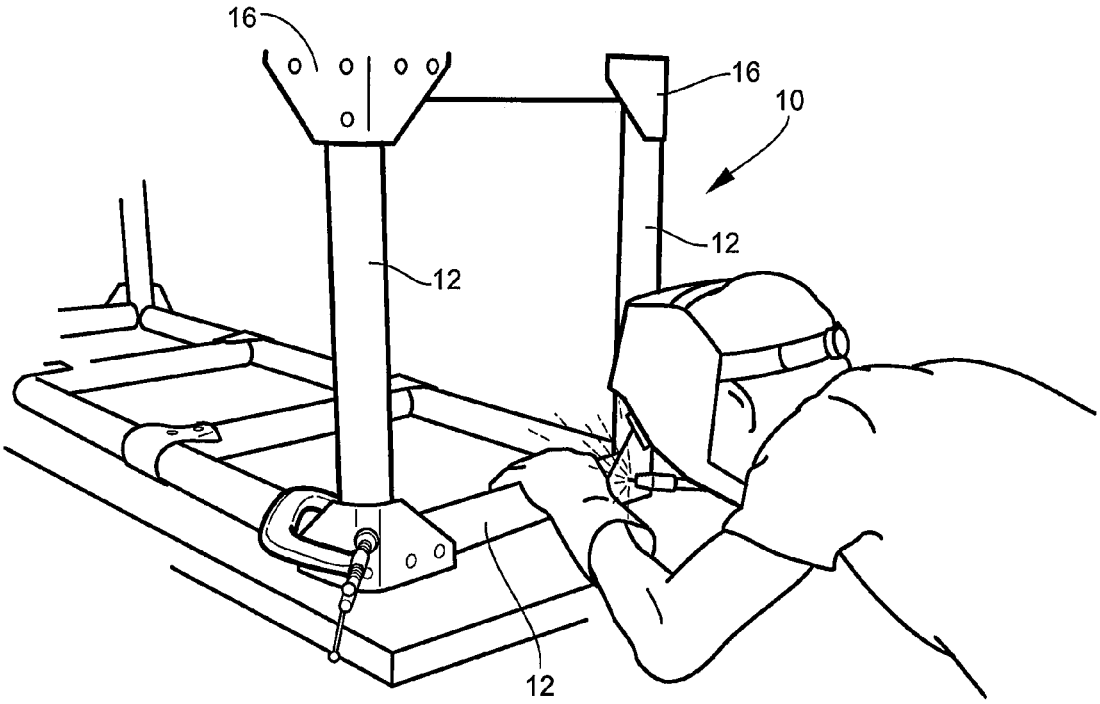
FIG. 5 is a view of forming the plug welds.
Figure 6:
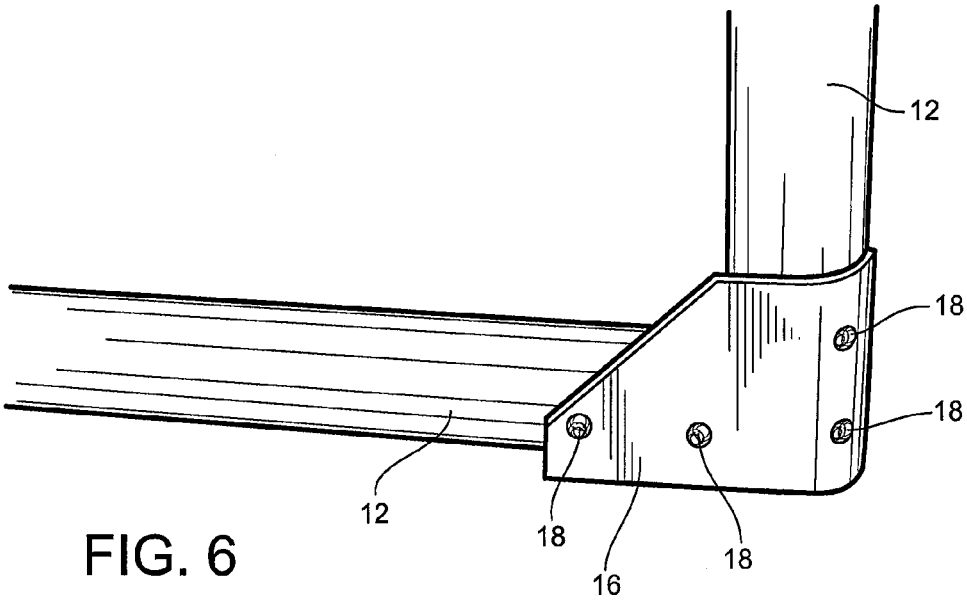
FIG. 6 is a view of plug welds prior to finishing.
Figure 8:
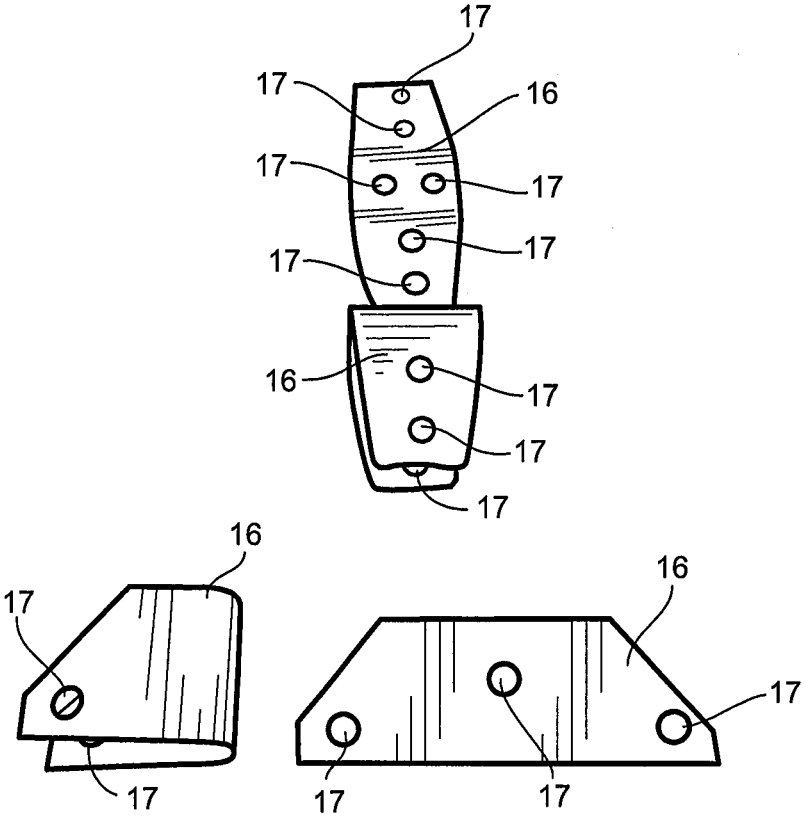
FIG. 8 is a view of several saddles.

Saddle 16 is wrapped around the joint 14. Saddle 14 may be a flat metal member with at least two holes 17 therethrough, a hole 17 overlays each frame member 12, see for example FIG. 4. Wrapped around, as used herein, may mean that the saddle may be initially a flat member, but when placed around the joint, the saddle may be bent and/or bent and contoured and/or contoured to fit snuggly around the frame members. The saddle 16 may be malleable, so that the saddle may be bent around the joint. The saddle 16 should snuggly fit around, or be contoured to, or be in intimate contact, with the frame members, so as to avoid any free space therebetween (e.g., reduce the chance of movement between the saddle and the frame members). The saddle 16 may have a variety of shapes, for example see FIGS. 6-8. Hole 17 may be punched in the flat metal member. Any number (e.g., 1, 2, 3 . . . ) of holes 17 may be in saddle 16, so long as there is at least one hole associated with each frame member. In some embodiments, there may be two holes associated with each frame member. The number of holes associated with each frame member need not be the same. In the embodiment shown in FIG. 4, the saddle 16 is a corner saddle with two holes 17 overlaying the post frame member, two holes 17 overlaying the one frame member, and two holes 17 overlaying the third frame member (not visible).

Plug welds 18 are used to fill the holes 17 in the saddle 16 and join the saddle 16 to the frame member 12. Plug welds are not spot weld, see http://www.mig-welding.co.uk/plug-weld.htm, incorporated herein by reference. With plug welding, a weld metal, for example from a wire welder (such as a MIG welder), fills the hole 17 in saddle 16, joins the saddle 16 to the frame member 12, and secures the joint 14 from movement.

In erection (or assembly), see generally FIGS. 2-7, frame members 14 are abutted together. No coping or fitting (i.e., cutting) of the tubular frame members is necessary. The frame members 14 may be tacked (or tack welded) 15 together, see FIGS. 2-3. Saddle 16 is wrapped around the joint 12, so that at least one hole 17 of the saddle 16 overlays each of the frame members 12. The saddle 16 is temporarily affixed to the joint 14, for example with a clamp C (a C-clamp is shown), see FIG. 4. Saddle 16 is then plug welded to the frame members 12, see FIGS. 5-7. With plug welding, a weld metal fills the hole 17 of saddle 16 and joins the saddle 16 to the frame member 12. The clamp is then removed, any excess weld metal may be removed (e.g., grinding), and the plug weld is finished, as necessary or desired. After all plug welding, the frame 10, see FIG. 1, is ready for use.

The present invention may be embodied in other forms without departing from the spirit and the essential attributes thereof, and, accordingly, reference should be made to the appended claims, rather than to the foregoing specification, as indicated the scope of the invention.

I claim:

1. A method for erecting or assembling a frame comprises the steps of:

forming a joint with at least two frame members placed at an angle to one another, each of the frame members is a metal tube, no coping nor fittings are used to form the joint;

wrapping the joint with a saddle, the saddle is a bent flat metal member with at least one hole overlaying each of the frame members; and plug welding the saddle to each of the frame members by filling each of the at least one hole with weld metal.

2. The method of claim 1 wherein the bent flat metal member has at least two holes overlaying at least one of the frame members.

3. The method of claim 1 wherein the saddle is contoured to the frame members.

4. The method of claim 1 wherein the metal tube is an electrical conduit.

5. The method of claim 1 wherein the frame is a non-structural frame.

6. A method for erecting or assembling a frame comprises the steps of:

forming a joint with at least two frame members placed at an angle to one another, the frame members are tubes, no coping nor fittings are used to form the joint;

wrapping the joint with a saddle, the saddle is a bent flat metal member with at least one hole overlaying each of the frame members; and plug welding the saddle to each of the frame members by filling each of the at least one hole with weld metal.

7. The method of claim 6 wherein the bent flat metal member has at least two holes overlaying each of the frame members.

8. The method of claim 6 wherein the saddle is contoured to the frame members.

9. The method of claim 6 wherein the weld metal is provided by a wire arc welding machine.

10. The method of claim 6 wherein the tube is a metal tube.

* * * * *